United States Patent [19]

Parrotta

[11] Patent Number: 4,486,033

[45] Date of Patent: Dec. 4, 1984

[54] SUBLIMABLE DYE IMAGING OF LOTTERY TICKET AND COMMERCIAL GAME COUPON AND THE LIKE

[75] Inventor: Michael A. Parrotta, Hamilton Square, N.J.

[73] Assignee: Beatrice Foods Co., Chicago, Ill.

[21] Appl. No.: 514,108

[22] Filed: Jul. 15, 1983

[51] Int. Cl.[3] ..... G09F 3/02

[52] U.S. Cl. ..... 283/94; 283/107; 283/903; 283/904; 427/7; 427/54.1; 427/55; 427/384

[58] Field of Search ..... 427/7, 54.1, 55, 384; 283/8 R, 9 R, 72, 94, 903, 904, 107; 428/916; 430/41, 106, 124, 126

[56] References Cited

U.S. PATENT DOCUMENTS

| | | | |
|---|---|---|---|
| 3,871,119 | 3/1975 | Mayer | 428/916 |
| 4,172,721 | 10/1979 | Byrne | 430/41 |
| 4,180,929 | 1/1980 | Schultz | 283/94 |
| 4,232,076 | 11/1980 | Stetson et al. | 427/270 |
| 4,389,472 | 6/1983 | Neuhaus et al. | 428/916 |

*Primary Examiner*—John H. Newsome

*Attorney, Agent, or Firm*—Schlesinger, Arkwright, Garvey & Fado

[57] ABSTRACT

A process for permanently imaging data on lottery tickets and the like which comprises of steps of; providing an ink receptive, non-shrinking resinous coating on a webbed coupon substrate and heat curing the same, applying to the ink receptive resinous coating, imaging data by an ink jet printer using a sublimable dye, drying the dye, applying an ultraviolet curable resinous coating over the dye, coating the ultraviolet curable resinous coating by ultraviolet light and further heating the substrate between 275° Fahrenheit and 400° Fahrenheit thereby causing the dye to permanently sublime into the ink receptive resinous coating and the ultraviolet curable resinous coating.

20 Claims, 5 Drawing Figures

SUBLIMABLE DYE IMAGING OF LOTTERY TICKET AND COMMERCIAL GAME COUPON AND THE LIKE

BACKGROUND AND FIELD OF THE INVENTION

This invention relates to such items as lottery tickets, commercial game coupons and identification coupons and more particularly to the application of imagery and data on the item such that the information printed is both permanent and tamper proof. Lottery games, as well as other chance games wherein a number of tickets are sold, have become increasingly popular in recent years. The key problem to a promoter associated with such games is fraud. The data printed on the ticket must be both permanent and tamper proof to insure the integrity of the game.

Numerous prior art lottery tickets exist, which attempt to insure the reliability of the game. Several prior art tickets exist which incorporate laminates having at least one releasable coating which when removed exposes the image data and therefore prevents undetected tampering. Examples of these prior art devices are U.S. Pat. Nos. 4,095,824 to Bachman, 4,120,445 to Carrier and 4,299,637 to Oberdeck. U.S. Pat. No. 4,120,445 discloses a ticket whose image data cannot be detected by an intervening person without subsequent mutilation of the ticket. None of the aforementioned prior art devices protect the image data printed on the ticket from manipulation. European Pat. No. 1887/12 Nov. 1980, discloses a tamper proof identification card involving a silk screen printing process wherein a photo-sensitive solution including a diazonium salt, coupler, stabilizer, resin and solvent are applied to a transparent plastic support. The photo-sensitive solution is dried and irradiated with ultraviolet light. The non-exposed areas are then developed with an alkaline solution. A resinous film is applied and the support is heated followed by cooling, thereby locking the image between the laminate. U.S. Pat. No. 4,230,784 to Nishiguchi et al discloses an image forming process wherein the image forming particles containing a subliminal dye are heated causing the dye to sublime into a photo-conductive support. U.S. Pat. Nos. 4,266,229 and 4,258,367 to Mansukhani disclose jet ink compositions including one diazo derivative which is applied to a plastic coated base and irradiated with ultraviolet light to produce a visible image.

The aforementioned prior art devices either cover the image data with a releasable coating which would indicate tampering or sublime the image data into a plastic base and bond a permanent plastic film over the image bearing plastic base. None of the prior art patents disclose the diffusion of the image data into all the surrounding resinous layers. Accordingly, the resulting ticket will offer a high degree of security and image permanency not formally available with other image tickets.

OBJECTS AND SUMMARY

It is, therefore, an object of the present invention to provide a lottery ticket offering security in a high degree of permanence for the data imprinted thereon.

It is another object of this invention to provide a lottery ticket or commercial game coupon which is produced by a continuous operation by sequentially coating a substrate in webbed form, printing and irradiating the webbed substrate.

A further object of this invention is to provide a lottery ticket which is easy to manufacture, and is uncomplicated and cost effective.

To summarize this invention, it relates to a method and use of a jet applied sublimable dye to form imaging data on lottery tickets as well as other games coupons and the like. More specifically, this would include the application of a resinous layer on a webbed substrate, curing the same and applying ticket data via an ink jet which contains a sublimable dye. After drying by an infrared dryer an ultraviolet resinous coating is applied and cured by ultraviolet lamps at a specific temperature. The dye permanently sublimes into the surrounding resinous layers providing image data which can not be tampered with nor altered without destruction of the ticket.

These and other objects of this invention will become apparent from the following description and claims.

DESCRIPTION OF THE DRAWINGS

In the accompanying drawings which illustrate by way of example the embodiment of this invention.

DETAILED DESCRIPTION OF THE PREFERRED EMBODIMENTS

Figure 1:
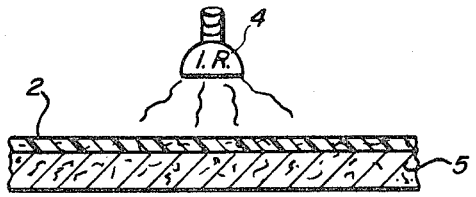
FIGS. 1–5 illustrate diagramatically fragmentary elevational view of the steps of the invention.

The entire process is a continuous operation wherein the ticket substrate S is in webbed form and is made of paper or similar materials such as plastic films or foil laminants. As illustrated in FIG. 1 an ink receptive, non-shrinking coating 2 is applied to the ticket substrate S. The coating is applied by any conventional means and is limited to a thickness between 0.2 ml to 1.0 ml. The only requisites of the resinous coating 2 is that it be non-shrinking and ink receptive.

Examples of organic resins which are in the scope of the present invention are:

polyvinyl chloride
polyvinyl butyrate
polyvinylidene chloride
polyisoprene
SBR (styrene-butadiene)
NBR (nitrile butadiene)
polyvinyl pyrrolidone
polychloroprene
polyvinyl acetate
EVA (ethylene vinyl acetate)
cellulosics (e.g. CMC carboxymethyl cellulose)
polyacrylate
polyvinyl alcohol
polyacrylamide
polyethylene oxide After application of the resinous coating 2, the coating is cured with conventional heat. Infra-red heat is applied by the infra-red lamp 4 as in FIG. 1. The curing is effected in a matter of seconds and the coated substrate continues on to the next processing step. Other heat application means such as rollers, irons etc. may also be used.

Figure 2:
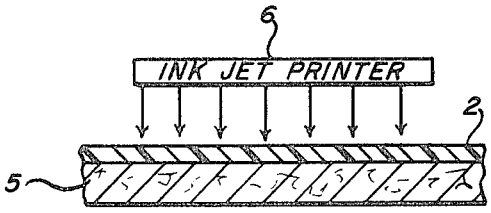

FIG. 2 discloses the application of the imaging data by the ink jet printer 6. The imaging data applied is in the form of a sublimable dye. Such dyes are well known in the art, the only restriction in the present invention being that it be both water and alcohol insoluble so as to prevent leaking out. An example of which is 1-amino-6-nitro-2-naphthyl-4-sulfonic acid dye.

Additional examples of dyes which can be used according to the present invention, are:
3-Hydroxy-2-naphtho-o-toluidide
Erionyl Printing Black R (Ciba-Geigy)
Levalan Grey N-RL (Mobay)
Telon Fast Black (Mobay)
Benzo Black A-200 (Mobay)
Levafix Black EB (Mobay)
Nigrosine WLF (Mobay)
Erio Blue GRL (Ciba-Geigy)
Amacid Black (Ciba-Geigy)

Figure 3:
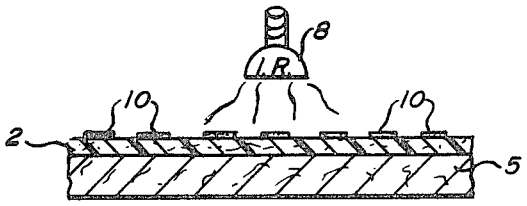

After the imaging data is applied to the surface of coating 2, it is dried. Any form of conventional radiation heat is applicable. The present embodiment discloses a use of an infra-red dryer 8 which dries the newly deposited image data 10 as illustrated in FIG. 3. The drying temperature is within the range of 275° Fahrenheit to 400° Fahrenheit; and, preferably above 300° Fahrenheit. Drying is very rapid once the temperature of 275° is reached. The drying time can be decreased by the application of higher heat but not so high as to destroy the plastic of applied coat. A fraction of a second to a several seconds is sufficient, depending on the temperature of the heat applied.

Figure 4:
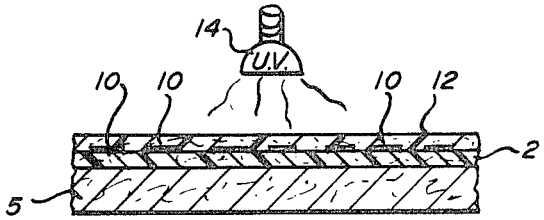

A second coating is now applied. This coating is an ultra-violet (UV) curable resinous coating 12. The second coating 12, as illustrated in FIG. 4, is both non-shrinking and ink receptive. A typical example of the second coating 12 can be produced as follows:
30 parts/100 of CMD-1700 (Celrad acrylic oligimer)
30 parts/100 of CMD-3700 (Celrad epoxy oligimer)
20 part/100 hexane diol diacrylate
10 parts/100 polyvinyl pyrrolidone (water soluble monomer)
5 parts/100 benzophenone (initiator)
5 parts/100 N-methyl diethanol amine (synergist)

Further examples of organic resins which can be used in accordance with the present invention are compositions of phont-initiated compounds containing monomeric materials or diluents, of which can be referred to generally as polymeric materials. Examples illustrative of polymers containing saturated groups are:
polyofins
vinyl polymers
polyethers
polyesters
polylactones
polyamides
polyurethanes
polyureas
polysiloxanes
polysulfides
polyketones
polyformaldehydes
phenol-formaldehyde polymers
natural and modified polymers
heterocyclic polymers Illustrative of these polymers are the acrylic types:
poly(acrylic acid)
poly(methyl acrylate)
poly(ethyl acrylate)
poly(methacrylic acid)
poly(methyl methacrylate)
poly(vinyl chloride)
poly(vinyl alcohol)
poly(ethylene oxide)
poly(propylene oxide)
poly(caprolactone)

The resin is coated over the image data at a thickness between 0.2 ml and 1.0 ml. The ultraviolet curable coating 12 is cured by ultraviolet lamp 14 to lock the image 10 in between resinous layers 12 and 2. The curing is effective in a matter of seconds and the substrate is moved on to the final heating step.

Figure 5:
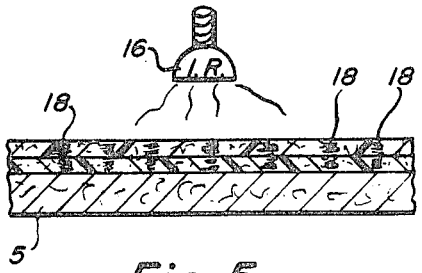

The final heating step, as illustrated in FIG. 5 causes the image data 10 to sublime, that is change its state from a solid to a gaseous form, and thus be transferred into the lower resinous coating 2 and the upper resinous coating 12. The diffusion into the upper and lower surrounding plastic layers 12 and 2 is generally illustrated by numeral 18. The final heating step is at a temperature above 275° Fahrenheit and preferably between 300° and 400° Fahrenheit. The sublimation occurs when the surface temperature of the resinous coating falls within this temperature range. At transfer, the image becomes permanently locked in throughout the resinous coating insuring a tamper proof ticket.

While this invention has been described as having a preferred design, it will be understood that it is capable of further modification. This application is, therefore, intended to cover any variations, uses and/or adaptations of the invention following from the present disclosure as come within known or customary practice in the art to which this invention pertains, and as may be applied to the essential features hereinbefore set forth and fall within the scope of this invention or the limits of the claims.

What I claim is:

1. A process for permanently imaging data on lottery tickets and the like which comprises the steps of:
a. providing an ink receptive, non-shrinking resinous coating on a webbed coupon substrate and heat curing the same;
b. applying to said ink receptive resinous coating imaging data by an ink jet printer using a sublimable dye;
c. drying said dye;
d. applying an ultraviolet curable resinous coating over said dye;
e. curing said ultraviolet curable resinous coating by ultraviolet light;
f. further heating said substrate between about 275° and 400° Fahrenheit causing said dye to permanently sublime into said ink receptive resinous coating and said ultraviolet curable resinous coating.

2. A process as claimed in claim 1, and wherein:
a. said ink receptive, resinous coating is applied at a thickness between 0.2 ml to 1.0 ml.

3. A process as claimed in claim 1, and wherein:
a. said ultraviolet curable resinous coating is applied at a thickness between 0.2 ml to 1.0 ml.

4. A process as claimed in claim 1, and wherein:
a. said dye is dried by infra-red heat.

5. A process as claimed in claim 1, and wherein:
a. said ultraviolet curable resinous coating is ink receptive to a sublimable dye.

6. A process as claimed in claim 1, and wherein:
a. said dye drying temperature occurs between 275° Fahrenheit and 400° Fahrenheit.

7. A process as claimed in claim 1, wherein:
a. said further heating is at a temperature preferably greater than 300° Fahrenheit and less than or equal to 400° Fahrenheit.

8. A permanently imaged lottery ticket and the like by a process as claimed in claim 1.

9. A process for permanently imaging data on a lottery ticket web or the like which comprises the steps of:

a. providing a substrate;

b. applying to said substrate a first ink transparent, non-U.V. curable, non-shrinkable dual function resinous coating having a non-absorbable, sublimable ink surface receptive first stage and an absorbable, sublimable ink surface receptive second stage;

c. heat curing said first coating;

d. applying a sublimable ink to the surface only of said first cured coating;

e. rapidly drying said ink while preventing sublimation of said ink;

f. applying a second ink transparent dual function U.V. curable resinous coating having a non-absorbable, sublimable ink surface receptive first stage and an absorbable ink surface receptive second stage to said first cured sublimable ink non-U.V. curable resinous coating and over said rapidly dried ink;

g. applying U.V. light to said second resinous coating for curing the same and locking said sublimable ink between said first and second cured resinous coating while said first and second coatings are in said first non-absorbable sublimable stage thereby producing a finally coated web;

h. applying heat to said finally coated web of a sufficient temperature and for a sufficient time period to cause said first and second coating to become absorptive while simultaneously subliming said ink into said first and second cured resinous coatings;

i. thereby providing a tamper proof lottery ticket web or the like.

10. A process for permanently imaging data on a lottery ticket web or the like which comprises the steps of:

a. providing a first ink transparent, sublimable ink absorbable, non-shrinking resinous coating on a webed coupon substrate;

b. heat curing said first coating;

c. applying sublimable ink in the form of image data to the surface of said cured first coating;

d. quick drying said sublimable ink without subliming said ink;

e. applying a second ink transparent, sublimable ink absorbable, U.V. curable non-shrinking resinous coating over said cured first coating and said image data to form a final coated web;

f. applying U.V. light to cure said second coating without subliming said ink thereby locking the image data on the surface between said cured first coating and said cured second coating and;

g. applying heat to said coated web within a range of about 275° and 400° F. for a time period sufficient to cause said locked image data to simultaneously sublime and be permanently locked in said cured first coating and said cured second coating;

h. thereby providing a permanent tamper proof lottery ticket web or the like.

11. A process as claimed in claim 1, and wherein:

a. said sublimable dye is water and alcohol insoluble.

12. A process as claimed in claim 9, and wherein:

a. said sublimable ink is water and alcohol insoluble.

13. A process as claimed in claim 10, and wherein:

a. said sublimable ink is water and alcohol insoluble.

14. A process as claimed in claim 9, and wherein:

a. said first ink transparing, non-U.V. curable, non-shrinkable dual function resinous coating is applied in a thickness of between about 0.2 ml to 1.0 ml., and b. said second ink transparent dual function U.V. curable resinous coating is applied in a thickness of between about 0.2 ml to 1.0 ml.

15. A process as claimed in claim 10, and wherein:

a. said first ink transparent sublimable ink absorbable non-shrinking resinous coating is applied in a thickness of between about 0.2 ml to 1.0 ml, and b. said second ink transparent sublimable ink absorbable U.V. curable non-shrinking resinous coating is applied in a thickness between about 0.2 ml to 1.0 ml.

16. A process as claimed in claim 9, and wherein:

a. said heat applied to said finally coated web is within a range of about 275° to 400° F.

17. A process as claimed in claim 9, and wherein:

a. said rapid drying temperature of said sublimable ink occurs within a range of about 275° F. and 400° F. and for a period of time of up to several seconds.

18. A process as claimed in claim 10, and wherein:

a. said quick drying of said sublimable ink occurs within a range of about 275° and 400° F. and for a period of time of up to several seconds.

19. A process as in claim 16, and wherein:

a. said heat applied to said finally coated web is between 300° and 400° F.

20. A permanently imaged lottery ticket web or the like by the process of claim 9.

* * * * *